US009731216B2

(12) United States Patent
Richardson et al.

(10) Patent No.: US 9,731,216 B2
(45) Date of Patent: Aug. 15, 2017

(54) FLYING DISC

(75) Inventors: Brad Charles Richardson, Brown City, MI (US); Chad Michael Richardson, Brown City, MI (US)

(73) Assignee: MVP Disc Sports, LLC, Brown City, MI (US)

( * ) Notice: Subject to any disclaimer, the term of this patent is extended or adjusted under 35 U.S.C. 154(b) by 233 days.

(21) Appl. No.: 13/164,057

(22) Filed: Jun. 20, 2011

(65) Prior Publication Data

US 2012/0322336 A1 Dec. 20, 2012

(51) Int. Cl.
*A63H 27/00* (2006.01)
*A63H 33/18* (2006.01)

(52) U.S. Cl.
CPC ..... *A63H 33/18* (2013.01)

(58) Field of Classification Search
CPC ..... A63H 33/18; A63B 65/08; A63B 67/14
USPC ..... 446/46–48; 473/588–590
See application file for complete search history.

(56) References Cited

U.S. PATENT DOCUMENTS

| | | | | | |
|---|---|---|---|---|---|
| 3,710,505 | A | | 1/1973 | Linenfelser | |
| 4,115,946 | A | * | 9/1978 | Vukmirovich | 446/46 |
| 4,173,839 | A | * | 11/1979 | Kovac | 446/46 |
| 4,204,357 | A | * | 5/1980 | Harrington | 446/47 |
| 4,212,131 | A | * | 7/1980 | Ross, Jr. | 446/48 |
| 4,334,385 | A | | 6/1982 | Melin et al. | |
| 4,356,660 | A | * | 11/1982 | O'Brien | 446/46 |
| 4,466,212 | A | * | 8/1984 | Lehman | 446/46 |
| 4,503,635 | A | * | 3/1985 | Harrington | 446/46 |
| 4,568,297 | A | | 2/1986 | Dunipace | |
| 4,940,441 | A | * | 7/1990 | Novinsky | 446/46 |
| 5,014,990 | A | | 5/1991 | Kaser et al. | |
| 5,152,481 | A | * | 10/1992 | Cote et al. | 244/153 R |
| 5,326,299 | A | * | 7/1994 | Jasinski | 446/46 |
| 5,358,440 | A | * | 10/1994 | Zheng | 446/48 |
| 5,366,403 | A | | 11/1994 | Weiss | |
| 5,423,705 | A | | 6/1995 | Solomon, II | |
| 5,476,405 | A | * | 12/1995 | Clayborne | 446/46 |
| 5,484,159 | A | | 1/1996 | Dean et al. | |
| 5,531,624 | A | | 7/1996 | Dunipace | |
| 5,540,610 | A | | 7/1996 | Sneddon | |
| 5,951,353 | A | * | 9/1999 | Moore | 446/46 |
| 6,113,453 | A | | 9/2000 | Stuffelbeam | |
| 6,174,214 | B1 | | 1/2001 | Cooper | |
| 6,179,737 | B1 | * | 1/2001 | Adler | A63B 65/10 446/46 |
| 6,241,570 | B1 | * | 6/2001 | Thorne, III | 446/46 |
| 6,755,711 | B2 | * | 6/2004 | McClung et al. | 446/46 |
| 6,840,836 | B1 | * | 1/2005 | Siverson | 446/46 |
| 6,887,119 | B2 | * | 5/2005 | Bloeme et al. | 446/46 |

(Continued)

OTHER PUBLICATIONS

Guidelines & Procedures for Manufacturers to Certify that Equipment Complies with PDGA Technical Standards, Rev. Jun. 15, 2010, 9 pages.

*Primary Examiner* — Aarti B Berdichevsky
*Assistant Examiner* — Urszula M Cegielnik
(74) *Attorney, Agent, or Firm* — Reising Ethington, P.C.

(57) ABSTRACT

A flying disc includes a hub composed of polymeric material, a ring composed of polymeric material and coupled to the hub. The hub and the ring may have different specific gravities by being composed of different materials or by having a weighting product embedded therein, or a weighting product may be carried between the hub and the ring.

32 Claims, 4 Drawing Sheets

(56) References Cited

U.S. PATENT DOCUMENTS

| | | | | |
|---|---|---|---|---|
| 6,991,508 | B2 * | 1/2006 | McClung et al. | 446/46 |
| 7,007,290 | B2 * | 2/2006 | Wilcoxson et al. | 720/718 |
| 7,096,826 | B2 | 8/2006 | Markham | |
| 7,217,169 | B1 * | 5/2007 | Anderson | 446/46 |
| 7,294,036 | B2 | 11/2007 | Potts | |
| 7,300,368 | B2 * | 11/2007 | Hylak | 473/588 |
| 8,402,923 | B2 * | 3/2013 | Jager | 119/707 |
| 2006/0189246 | A1 | 8/2006 | Stark | |
| 2006/0194504 | A1 * | 8/2006 | Ragonetti | A01K 15/025 446/46 |
| 2007/0099535 | A1 * | 5/2007 | Riebersal | A63H 23/12 446/46 |
| 2007/0207883 | A1 | 9/2007 | Kenner | |
| 2012/0077409 | A1 * | 3/2012 | Busse | A63H 33/18 446/46 |

* cited by examiner

FLYING DISC

TECHNICAL FIELD

The present invention relates generally to amusement devices, and more particularly to an aerodynamically supported spinning disc.

BACKGROUND

Aerodynamically supported spinning discs are also known as flying discs and typically include one or two piece articles including a central plate portion and a ring portion that may be integral with or separately coupled to the central plate portion. Three scientific concepts are used to describe flight performance of a flying disc: aerodynamics, linear momentum, and angular momentum. Aerodynamics of a flying disc are influenced by the shape of the disc's profile, which changes how air flows around surfaces of the disc as it is in motion. Linear momentum is primarily influenced by an initial velocity of the disc coupled with the mass of the disc. Angular momentum is determined by inertia, and by angular velocity, which is determined by the ability of a thrower of the disc to exert torque on the disc.

BRIEF SUMMARY

A flying disc according to one implementation includes a hub composed of polymeric material and including a central axis, a flight plate extending in a direction transversely with respect to the central axis, and a hub rim. The disc also includes a ring composed of polymeric material and coupled to the hub rim, wherein the hub and the ring have different specific gravities.

According to another implementation, a weighted flying disc includes a hub composed of polymeric material and including a central axis, a flight plate extending in a direction transversely with respect to the central axis, and a hub rim. The disc also includes a ring composed of polymeric material coupled to at least a portion of the hub rim, and a weighting product carried between the ring and the hub rim.

According to a further implementation, a weighted flying disc includes a hub composed of polymeric material and including a central axis, a flight plate extending in a direction transversely with respect to the central axis, and a hub rim. The disc also includes a ring composed of polymeric material and coupled to the hub rim, and a weighting product embedded in at least one of the hub or the ring.

At least some of the objects, features and advantages that may be achieved by at least some forms of the invention include providing a flying disc that has a ring with a higher specific gravity than that of a hub to which the ring is coupled to modify flight performance of the disc; a weighted flying disc having a ring coupled to a hub so as to provide improved finger and thumb gripping; and is of relatively simple design, economical manufacture and assembly, rugged, durable, reliable, and in service has a long useful life.

Of course, other objects, features and advantages will be apparent in view of this disclosure to those skilled in the art. Various other flying discs embodying the invention may achieve more or less than the noted objects, features or advantages.

BRIEF DESCRIPTION OF THE DRAWINGS

These and other objects, features and advantages of the present invention will be apparent from the following detailed description of preferred embodiments and best mode, appended claims, and accompanying drawings in which:

DETAILED DESCRIPTION

Figure 1:
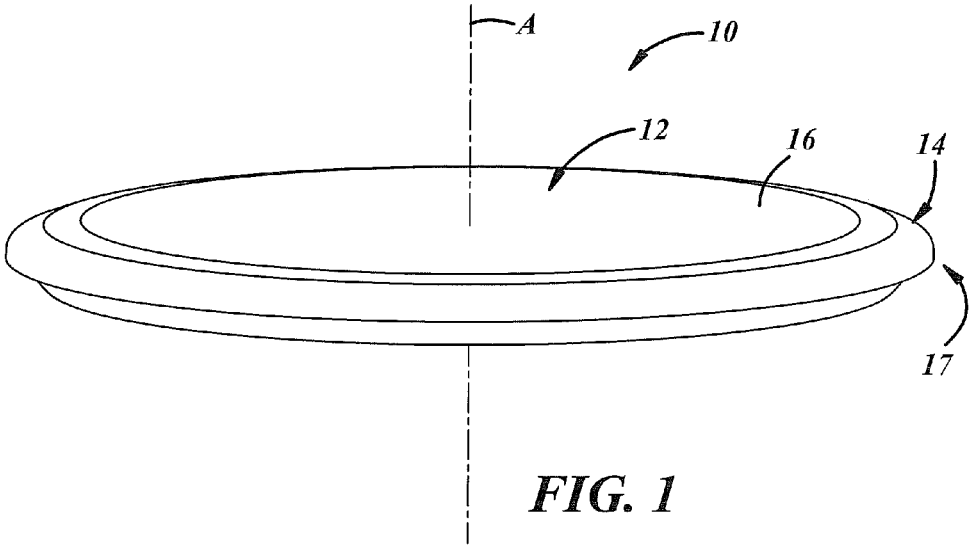
FIG. 1 is a perspective view of an illustrative form of a weighted flying disc.

Referring in more detail to the drawings, FIG. 1 illustrates an aerodynamically supported spinning disc, or flying disc 10. The flying disc 10 may be of two component construction, including a core or hub 12 composed of polymeric material, and a wing or ring 14 composed of polymeric material and coupled to the hub 12. The disc 10 also includes a flight plate 16 and disc rim 17 disposed radially outwardly of the flight plate 16. The disc 10 further includes a central axis A about which the disc 10 may spin or rotate when it is thrown. The disc 10 may be weighted to affect flight performance of the disc 10. As used herein, the term "weighted" includes adjusting the weight of the ring 14 relative to the hub 12, or vice-versa, in any suitable manner. For example, as will be described in greater detail below, at least one of the hub 12 or the ring 14 may include a weighting product embedded therein or therebetween, or the materials of the hub 12 and the ring 14 may have different specific gravities.

Figure 2:
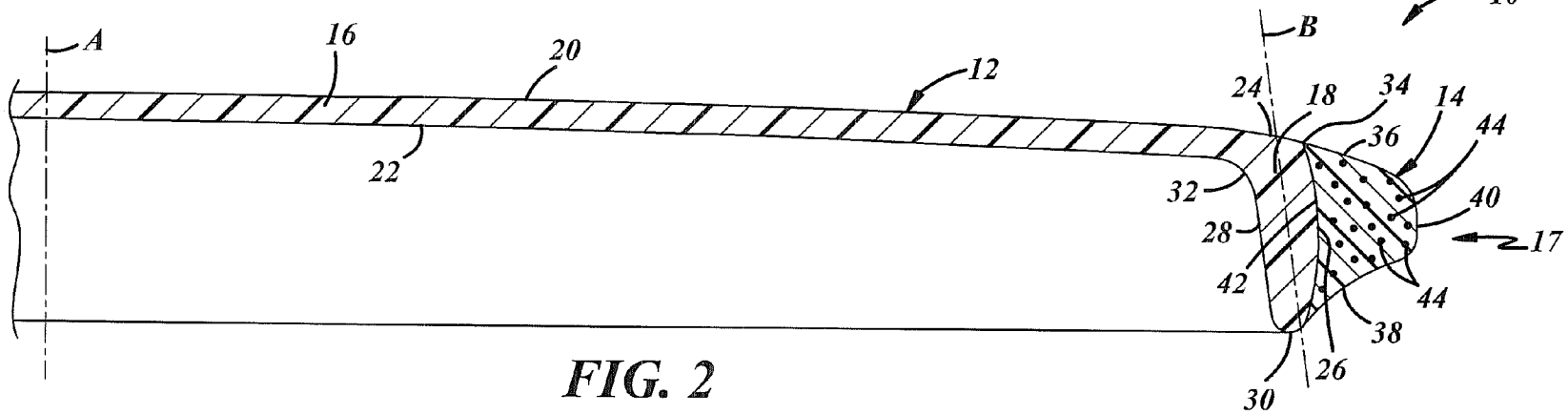
FIG. 2 is a fragmentary cross-sectional view of the disc of FIG. 1.

With reference to FIG. 2, the hub 12 includes the flight plate 16, which extends in a direction transversely with respect to the axis A. The hub 12 also includes a hub rim 18 that depends from and extends in a direction generally transversely with respect to the flight plate 16. The flight plate 16 and the rim 18 may be portions of a single component.

The flight plate 16 may extend in a generally radially outward direction from the axis A. The flight plate 16 may be circular with a saucer-like configuration that may be unbroken or continuous, without perforations, holes, or the like. The flight plate 16 may include an axially outer or upper surface 20, an axially inner or lower surface 22 that may be disposed axially opposite of the upper surface 20, and an axially outer beveled surface 24 at a radially peripheral portion of the flight plate 16 adjacent to the rim 18. The flight plate 16 may have a generally consistent thickness from the axis A extending radially outward to the beveled surface 24. The flight plate 16 may be generally dome-shaped or crowned with an apex at the axis A.

The rim 18 may extend from a radially outer periphery of the flight plate 16 in a generally axial direction. For example, the rim 18 may extend along a longitudinal axis B that may be parallel to the central axis A or may be disposed at an angle of about 0 to 12 degrees with respect to the central axis A. In more particular embodiments, the rim angle may be about 2 to 6 degrees, or about 4 degrees. As used herein, the term "about" includes within plus or minus 15%. The rim 18 may be circular and may be unbroken or continuous, without perforations, holes, or the like. The rim 18 may include a radially outer surface 26, a radially inner surface 28 that may be disposed radially opposite of the radially outer surface 26, and an axial end surface 30 between the outer and inner surfaces 26, 28. The outer surface 26 may be rounded or convex in a radial direction, the inner surface 28 may be conical with respect to the axis A and expanding radially outward in a direction extending away from the flight plate 16, and the axial end surface 30 may be rounded in an axial direction.

The surfaces of the flight plate 16 and the rim 18 may blend in any suitable manner. For example, the inner surface 28 of the rim 18 and the lower surface 22 of the flight plate 16 may be connected by a fillet 32. Similarly, the outer surface 26 of the rim 18 and the upper surface 20 of the flight plate 16 may be connected by a corner 34.

Figure 3:
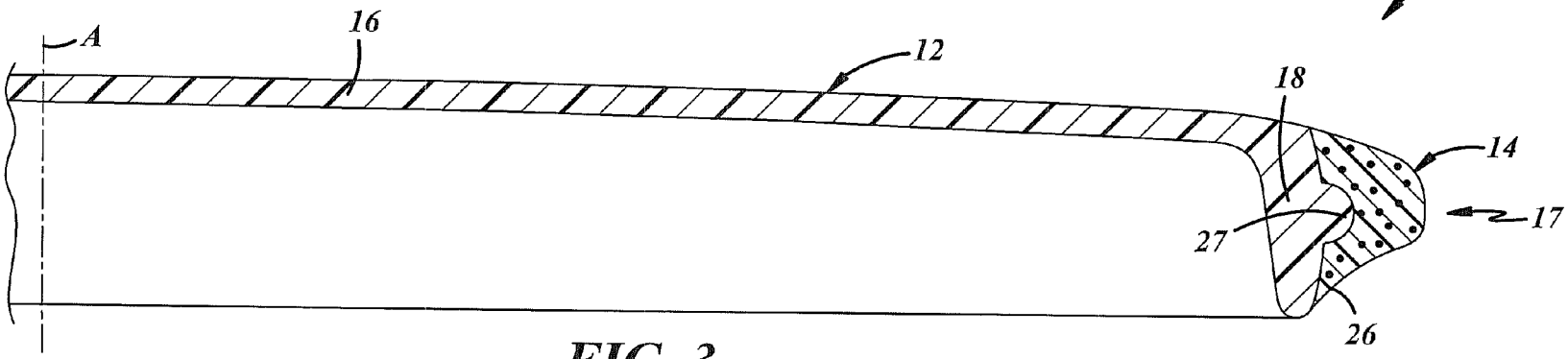
FIG. 3 is another fragmentary cross-sectional view of the disc of FIG. 1.

With reference to FIG. 3, the rim 18 may include at least one ring engagement feature 27 that may extend in a radially outward direction from the radially outward surface 26. The engagement feature(s) 27 may include an annular bead, which may include a single circumferentially continuous feature, or a plurality of circumferentially extending segments. The engagement feature(s) 27 may be semi-circular in cross section, as shown.

Referring again to FIG. 2, the ring 14 may be coupled to the rim 18 of the hub 12. The ring 14 may include an axially outer surface 36 that may extend in a generally radial direction from the corner 34, and an axially inner surface 38 that may extend in a generally radial direction from the axial end surface 30. Also, the ring 14 may include a radially outer surface 40 that may be free, and a radially inner surface 42 that may be bonded to the radially outer surface 26 of the hub rim 18 and may extend from the corner 34 to the axial end surface 30. The axially outer surface 36 may be excurvate and may be a continuation of the beveled surface 24 to establish a continuous external surface of the disc 10. The axially inner surface 38 may be incurvate. The radially outer surface 40 may be connected to the axially outer and inner surfaces by radii or rounded portions.

In the form illustrated in FIG. 2, the disc 10 also may include a weighting product 44 that may be embedded in the ring 14, wherein the weighting product 44 may include an aggregate material or particles. For example, the weighting product 44 may include a powder compounded into the material of the ring 14. More particularly, the weighting product 44 may include barium sulfate, tungsten, tungsten oxide, zinc, and/or brass. In any case, the ring 14 with the weighting product 44 may have a specific gravity between 0.96 and 5.0 and, more specifically, between 1.0 and 2.5. In a particular example, the ring 14 with the weighting product 44 may have a specific gravity between 1.14 and 1.4. The weighting product 44 alone may have any suitable specific gravity, for example, between 1.5 and 20.

The hub 12 may be composed of any suitable polymeric material to obtain any desirable flying disc attributes, which may include durability, flexibility, abrasion resistance, surface grip, and/or color. As used herein, the phrase "polymeric material" generally means relatively high-molecular-weight material of either synthetic or natural origin and may include thermosets, thermoplastics, and elastomers. The polymeric material of the hub 12 may include a thermoplastic urethane, a thermoplastic vulcanizate, a styrene-ethylene/butylenes-styrene, a vulcanized rubber, or any other suitable polymeric material. The polymeric material of the hub 12 may have a durometer between 30 and 70 on the Shore D scale and, more specifically, between 40 and 60 on the Shore D scale. In more particular examples, the hub material may have a durometer of about 47 or about 53 on the Shore D scale. The hub 12 may have a specific gravity between 0.92 and 1.25 and, more particularly, between 0.95 and 1.18. In particular examples, the specific gravity of the hub 12 may be 1.14, 1.15, or 1.16. In any event, in the embodiments where the ring 14 includes the weighting product 44, the specific gravity of the ring 14 with the weighting product 44 should be greater than the specific gravity of the hub 12.

In one form, the polymeric material of the ring 14 is the same as that of the hub 12. In other forms, the polymeric material of the ring 14 is different from that of the hub 12. Because the addition of the weighting product 44 to the ring material may increase the overall stiffness of the ring 14, it may be desirable to form the ring 14 of polymeric material having a lower durometer than that disclosed above with respect to the hub 12. For example, without any weighting product therein, the ring polymeric material may have a durometer between 20 and 55 on the Shore D scale and, more particularly, between 25 and 50 on the Shore D scale. In particular examples, the ring material alone may have a durometer of about 80 on the Shore A scale (or about 29 on the Shore D scale), or about 47 on the Shore D scale.

The relatively lower durometer ring 14 may be desirable for good grip of the disc 10. Good grip improves performance of the disc 10 allowing for more control when thrown. In one particular example, the durometer of the polymeric material of the ring 14 may be between 25 and 50 on the Shore D scale and the durometer of the polymeric material of the hub 12 may be between 40 and 60 on the Shore D scale.

By providing the ring 14 of the disc 10 with a higher density or specific gravity, a greater portion of the mass of the disc 10 is shifted radially outwardly towards the ring 14 and away from the axis A. Providing an increased mass around the circumference of the disc 10 increases rotational inertia of the disc 10 about its rotational axis A. Accordingly, when torque is imparted to the disc 10 by means of grasping and throwing the disc 10, the result may be an increased amount of angular momentum, which increases precession (also known as a gyroscopic effect). The increased gyroscopic effect on the disc 10 may improve desired flight characteristics by enabling the disc 10 to rotate about the axis A for a longer period of time. This means that the aerodynamic properties of the disc 10 may be maintained for a greater period of time during flight of the disc 10, allowing for greater distances and accuracy. The increased precession on the disc 10 also may reduce the effect of wind blowing the disc 10 off its flight path, thereby maintaining increased accuracy and consistency.

The mass specifications of the disc 10 may be determined by the diameter of the disc 10. For example, the maximum mass may be 8.3 grams per centimeter in diameter, up to a maximum mass of 200 grams. Also, the diameter of the disc 10 may be between 21 cm and 30 cm. The outer diameter of the hub 12 may be between 16 and 26 cm. The inner diameter of the ring 14 may be between 12 and 26 cm. As used herein, the term "diameter" includes a diametric measurement averaged over the entire circumference of the component being measured. The depth or axial length of the disc rim 17 may be between five and twelve percent of the diameter of the disc 10. The thickness of the flight plate 16 along the axis A may be between 0.025 cm and 0.5 cm. The thickness of the disc rim 17 along a radial dimension may be between 0.5 cm and 2.6 cm.

Embedding the weighting product 44 in the ring 14 may be beneficial for maintaining purity of the material of the hub 12. Weight additives, like the compounded powder, have a tendency to reduce abrasion resistance and durability of the polymeric material with which they are compounded. Accordingly, the material properties of the hub 12 would not be completely maintained throughout if such powder were added thereto. Instead, the weight additives may be added to the ring 14 to maintain desirable properties of the hub 12 such as cosmetic properties. For example, in the case of transparent materials like thermoplastic urethanes, the clarity and/or color of the hub 12 may be maintained, rather than becoming contaminated with weight additives.

In general, the components of the disc 10 may be manufactured according to techniques known to those skilled in the art, including injection molding, compression molding, vacuum forming, trimming, assembly, and the like. Also, the ring 14 may be coupled to the hub 12 in any suitable manner. For example, the ring 14 may be co-molded (or co-injection molded) with the hub 12, overmolded (or insert-molded) onto the hub 12, or molded according to any other suitable molding method. In another variation, the hub 12 may first be injection molded and the ring 14 assembled and/or adhered to the hub 12 in a subsequent manufacturing step. Generally, however, co-molding and over-molding methods are well known to those of ordinary skill in the art. If co-molding, over-molding, or like methods are used, it is generally desirable that the polymeric material used to form the ring 14 be compatible with, and capable of adhering to, the polymeric material used to form the supporting hub 12.

According to one insert-molding process, the hub 12 is pre-formed and the ring 14 is formed thereover. In fact, the polymeric material of the ring 14 may be overmolded to the pre-formed hub 12 before the polymeric material of the hub 12 has completely cooled. This avoids the need to manually mount, paste, or use an adhesive to adhere the ring 14 to the hub 12. In any case, the preformed hub 12 may be either manually or robotically assembled onto a specific predetermined location on a core pin of an injection molding machine (not shown). Mold halves of the injection molding machine may close around the core pin. Molten plastic may be injected into a mold cavity that is defined by the closed mold halves, the core pin, and the hub 12, wherein the molten plastic forms the ring 14 in the shape of the mold cavity. After molding, the mold halves separate or open and the core pin retracts, leaving the hub 12 intact with the ring 14 to create the disc 10, which may then be subjected to any desired finishing operations, for example, trimming or deflashing, and is thereafter ready for use.

By coupling the ring 14 to the hub 12, different disc models or disc profiles can be easily achieved by using a different ring profile while using a common hub 12. Coupling a different ring 14 on a common hub 12 enables introduction of different disc models for different disc appearance or flight performance to be accomplished in a more efficient manner.

Also, engravings may be placed on the ring 14 instead of the hub 12. With the ability to efficiently produce new models with different rings 14 on a common hub 12, identity engravings for each model are possible. Such engravings may include laser engravings or acid etching for good quality. This allows the hub 12 to be used on different disc models because it does not include engraving identification.

Furthermore, by coupling the ring 14 to the hub 12, parting line flash of the hub 12 may be hidden under the ring 14. For example, the ring 14 may encase the entire radially outer periphery of the hub 12 so as to hide a parting line or any injection mold vents that would otherwise present a surface imperfection that would contact and irritate a thrower's hand.

Figure 4:
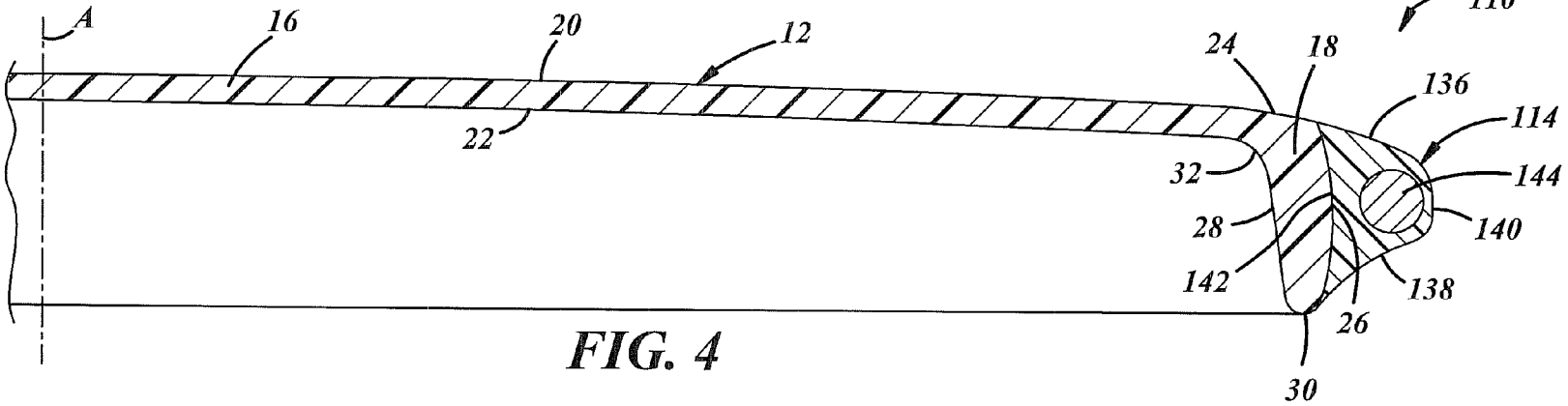
FIG. 4 is a fragmentary cross-sectional view of another illustrative form of a weighted flying disc.

FIG. 4 illustrates another presently preferred form of a flying disc 110. This form is similar in many respects to the form of FIGS. 1 through 3 and like numerals between the forms generally designate like or corresponding elements throughout the several views of the drawing figures. Accordingly, the descriptions of the discs 10, 110 are incorporated by reference into one another in their entireties. Additionally, the description of the common subject matter generally may not be repeated here.

The disc 110 may be of three or more component construction that includes the hub 12 of FIGS. 1 through 3, and a ring 114 composed of polymeric material and coupled to the hub 12, with a weighting product 144 embedded in the ring 114. The weighting product 144 may include at least one weight insert. In one variation, the at least one weight insert is a single element that may be circumferentially continuous. In another variation, the at least one weight insert includes a plurality of discrete weight inserts, for instance, between three and sixteen weight inserts. As used herein, the term "insert" includes a component or article, as contrasted from an aggregate or material compound. The weight inserts may be of any suitable size, as long as they are completely encased by the disc material with the inserts having no exposed areas. The inserts may be evenly spaced apart around the circumference of the disc so the weight distribution is consistent and balanced. The inserts may obtain a similar desired weight distribution around the circumference of the ring 14 as compared to the aggregate or particle form of the weighting product 44.

The at least one weighting product 144 may be located at the circumference of the ring 114, for example between 1 and 20 millimeters inward of the surfaces 136, 138, 140 formed by the polymeric material of the ring 114. Accordingly, the at least one weighting product 144 may be embedded in the ring 114 such that the product 144 is covered and not exposed.

Figure 5:
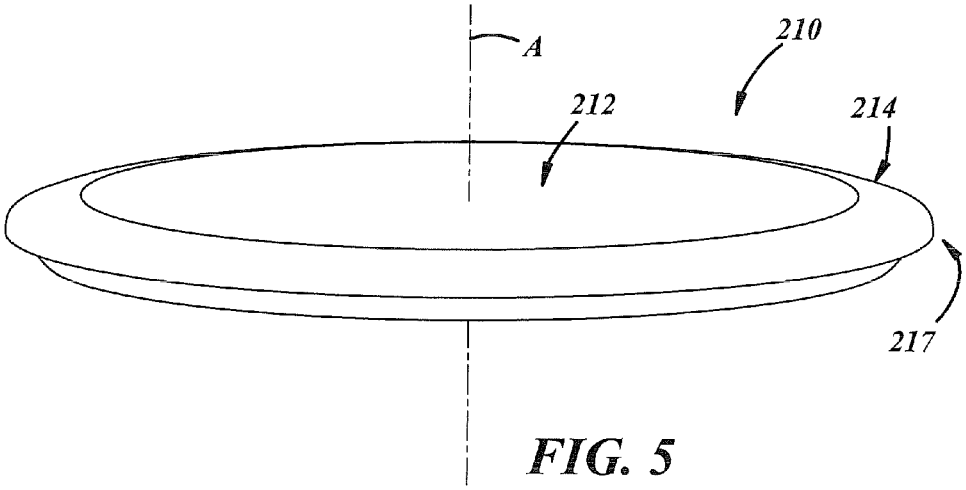
FIG. 5 is a perspective view of a further illustrative form of a weighted flying disc.
Figure 6:
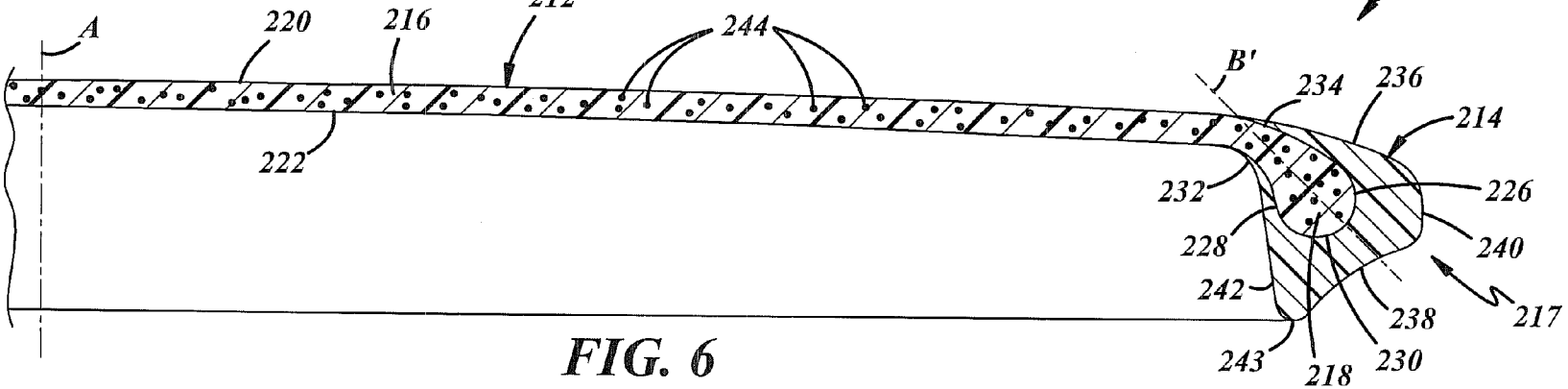
FIG. 6 is a fragmentary cross-sectional view of the disc of FIG. 5.

FIGS. 5 and 6 illustrate another presently preferred form of a flying disc 210. This form is similar in many respects to the forms of FIGS. 1 through 4 and like numerals between the forms generally designate like or corresponding elements throughout the several views of the drawing figures. Accordingly, the descriptions of the discs 10, 110, 210 are incorporated by reference into one another in their entireties. Additionally, the description of the common subject matter generally may not be repeated here.

FIG. 5 illustrates an aerodynamically supported spinning disc, or flying disc 210. The flying disc 210 includes a hub 212 composed of polymeric material, and a ring 214 composed of polymeric material and coupled to the hub 212. The disc 210 also includes a flight plate 216 and disc rim 217 disposed radially outwardly of the flight plate 216. The disc 210 further includes a central axis A about which the disc 210 may spin or rotate when it is thrown. As will be described in greater detail below, at least one of the hub 212 or the ring 214 includes a weighting product embedded therein to affect flight performance of the disc 210.

With reference to FIG. 6, the hub 212 includes a flight plate 216 that extends in a direction transversely with respect to the axis A, and a rim 218 that is inclined or extends in a direction generally transversely with respect to the flight plate 216. The flight plate 216 and the rim 218 may be portions of a single component.

The flight plate 216 may include an axially outer surface 220, and an axially lower surface 222 that may be disposed axially opposite of the outer surface 220. The flight plate 216 may have a generally consistent thickness from the axis A extending radially outward to the rim 218.

The rim 218 may extend from a radially outer periphery of the flight plate 216 in an axial and radial direction. For instance, the rim 218 may extend along a longitudinal axis B' disposed at an angle, for example between 30 and 90 degrees, with respect to the central axis A. The rim 218 may include a radially outer surface 226, a radially lower surface 228 that may be disposed radially opposite of the radially outer surface 226, and an axial end surface 230 between the outer and inner surfaces 226, 228. The surfaces 226, 228, 230 may be rounded or semi-circular.

The surfaces of the flight plate 216 and the rim 218 may blend in any suitable manner. For example, the radially lower surface 228 of the rim 218 and the axial lower surface 222 of the flight plate 216 may be connected by a fillet 232. Similarly, the outer surface 226 of the rim 218 and the outer surface 220 of the flight plate 216 may be connected by a radius 234.

Still referring to FIG. 6, the ring 214 may be coupled to the rim 218 of the hub 212. The ring 214 may be bonded to the rim surfaces 226, 228 230, and also may be bonded to the fillet 232 and the radius 234. The ring 214 may include an axially outer surface 236 that may extend in a generally radial direction from the radius 234, and an axially inner surface 238 that may extend in a generally radial direction from the axial end surface 230. The axially inner surface 238 may be incurvate, and the axially outer surface 236 may be excurvate and may be a continuation of the outer surface 220 to establish a continuous external surface of the disc 210. Also, the ring 214 may include a radially outer surface 240 that may be free, and a radially inner surface 242 that may extend from a location radially inward of the rim 218, for instance, from the fillet 232 to an axial end surface 243 axially inward of the rim 218. The radially outer surface 240 may be connected to the axially outer and inner surfaces 236, 238 by radii or rounded portions.

In the form illustrated in FIG. 6, the disc 210 also includes a weighting product 244 embedded in the hub 212, wherein the weighting product 244 includes an aggregate or particulates. More particularly, the weighting product 244 may be embedded in the flight plate 216. In any case, the hub 212 with the embedded weighting product 244 may have a specific gravity between 1.1 and 1.4, and the ring 218 may have a specific gravity between 0.92 and 1.18. More particularly, the specific gravity of the hub 212 with the embedded weighting product 244 may be between 1.15 and 1.25, and the specific gravity of the ring 218 may be between 1.0 and 1.14. In any event, in the embodiments where the hub 212 includes the weighting product 244, the specific gravity of the hub 212 with the weighting product 244 should be greater than the specific gravity of the ring 214.

By providing the hub 212 of the disc 210 with a higher density or specific gravity, a greater portion of the mass of the disc 210 is shifted radially inwardly towards axis A and away from the ring 214. This shift decreases rotational inertia of the disc 210 about its rotational axis A. When torque is imparted on the disc 210 by means of grasping and throwing, the result will be a decreased amount of angular momentum. Accordingly, the precession or gyroscopic effect will be reduced so that the disc 210 will have increased side to side action, which can be a desirable attribute.

Figure 7:
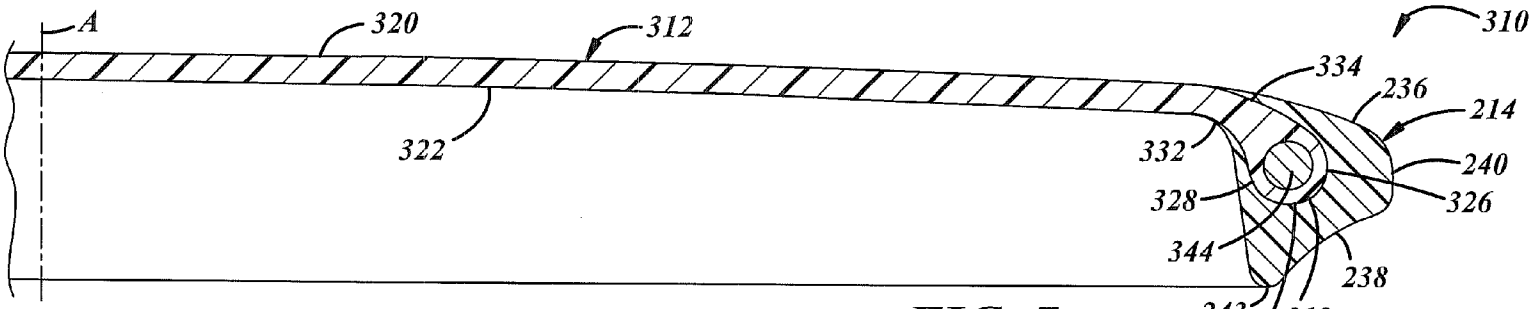
FIG. 7 is a fragmentary cross-sectional view of an additional illustrative form of a weighted flying disc.

FIG. 7 illustrates another presently preferred form of a flying disc 310. This form is similar in many respects to the form of FIGS. 1 through 6 and like numerals between the forms generally designate like or corresponding elements throughout the several views of the drawing figures. Accordingly, the descriptions of the discs 10, 110, 210, 310 are incorporated by reference into one another in their entireties. Additionally, the description of the common subject matter generally may not be repeated here.

The disc 310 includes a hub 312, and the ring 214 of FIGS. 5 and 6 composed of polymeric material and coupled to the hub 312, with a weighting product 344 embedded in the hub 312. The hub 312 includes a flight plate 316 that is inclined or extends in a direction transversely with respect to the axis A, and a rim 318 that extends in a direction generally transversely with respect to the flight plate 316. The flight plate 316 and the rim 318 may be portions of a single component. The flight plate 316 may include an axially outer surface 320, and an axially inner surface 322 that may be disposed axially opposite of the outer surface 320. The surfaces of the flight plate 316 and the rim 318 may blend in any suitable manner, and may include a fillet 332, and a radius 334.

The weighting product 344 may include at least one weight insert. In one variation, the at least one weight insert is a single element that may be circumferentially continuous. In another variation, the at least one weight insert includes a plurality of discrete weight inserts, for instance, between three and sixteen weight inserts.

The at least one weighting product 344 is located at the circumference of the rim 318, inward of an outer diameter of a radially outward surface 326 and inward of other surfaces 338, 330 formed by the polymeric material of the hub 312. Accordingly, the at least one weighting product 344 is embedded in the hub 312 such that the product 344 is covered and not exposed.

In the forms illustrated in FIGS. 5 through 7, the ring 214 may be coupled to the hubs 212, 312 for improved grip. For example, the ring 214 may be coupled axially and radially inside of the hub rims 218, 318 for increased finger grip surface area. In another example, the ring 214 may be coupled to extend axially and radially outside of the hub rims 218, 318 for increased thumb grip surface area to allow a thrower to exert greater angular acceleration on the disc 210.

In a further example, the ring 214 may be coupled completely over the hub rims 218, 318 for increased bonding surface area. The hub rims 218, 318 may be of semi-circular shape in cross section and may be circumferentially continuous, or may be circumferentially interrupted. In another example, the hub rims 218, 318 may be of dovetail shape. Such shapes may be beneficial to the durability of the disc 10 because they provide increased surface area to which the ring material can bond. Accordingly, the bond may be stronger than a typical flat interface.

Figure 8:
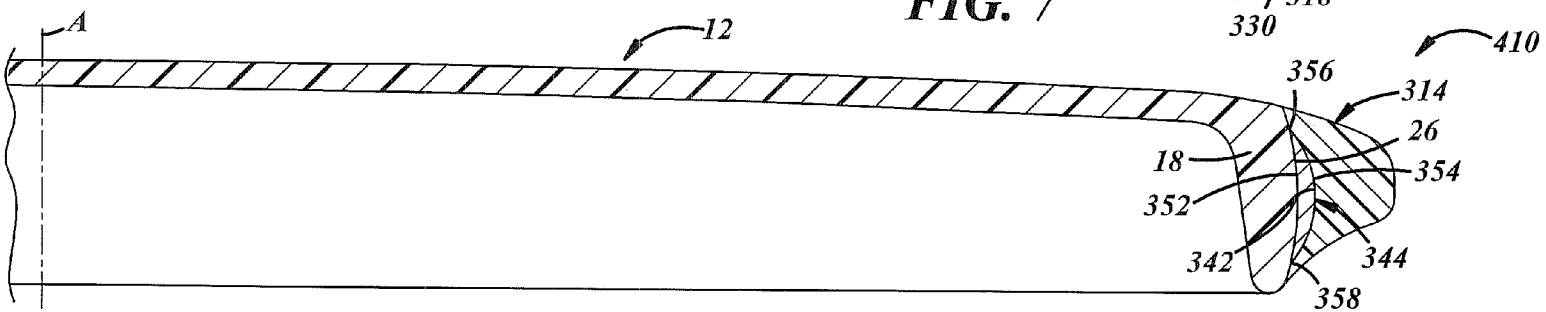
FIG. 8 is a fragmentary cross-sectional view of a yet another illustrative form of a weighted flying disc.

FIG. 8 illustrates another presently preferred form of a flying disc 410. This form is similar in many respects to the form of FIGS. 1 through 7 and like numerals between the forms generally designate like or corresponding elements throughout the several views of the drawing figures. Accordingly, the descriptions of the discs 10, 110, 210, 310, 410 are incorporated by reference into one another in their entireties. Additionally, the description of the common subject matter generally may not be repeated here.

The disc 410 includes the hub 12, and a ring 314 composed of polymeric material and coupled to the hub 12, with a weighting product 344 embedded in the disc 410 by being coupled between the hub 12 and the ring 314. The hub 12 and the ring 314 may or may not have any weighting product embedded therein. The weighting product 344 may include a radially inward surface 352 that may contact and correspond to the radially outer surface 26 of the hub rim 18. Likewise, the weighting product 344 may include a radially outward surface 354 that may contact and correspond to a radially inner surface 342 of the ring 314. The weighting product 344 also may include upper and lower ends 356, 358 that may be completely encapsulated by one or the other of the material of the hub 12 or ring 314.

Figure 9:
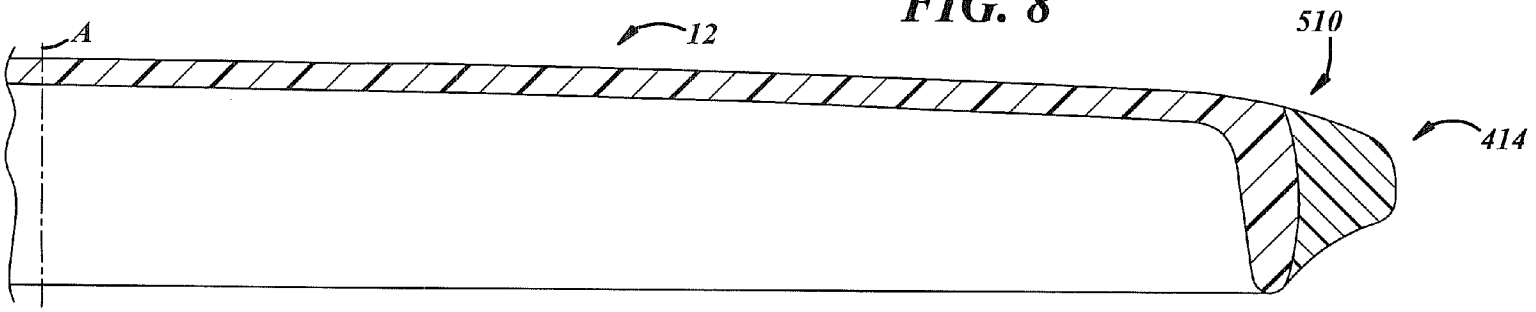
FIG. 9 is a fragmentary cross-sectional view of an illustrative form of a flying disc having portions with different specific gravities.

FIG. 9 illustrates another presently preferred form of a flying disc 510. This form is similar in many respects to the form of FIGS. 1 through 8 and like numerals between the forms generally designate like or corresponding elements throughout the several views of the drawing figures. Accordingly, the descriptions of the discs 10, 110, 210, 310, 410, 510 are incorporated by reference into one another in their entireties. Additionally, the description of the common subject matter generally may not be repeated here.

The disc 510 includes the hub 12, and a ring 414 composed of polymeric material and coupled to the hub 12, with no separate weighting product embedded in the disc 510. In one embodiment, the disc 510 may be weighted by composing the ring 414 of a polymeric material that has a specific gravity that is higher than that of the material of the hub 12. In another embodiment, the disc 510 may be weighted by composing the hub 12 of a polymeric material having a specific gravity that is higher than that of the ring 414.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A flying disc, comprising:

a unitary, one-piece hub composed of polymeric material and including a central axis, a circular and unperforated flight plate extending in a direction transversely with respect to the central axis, and a hub rim depending from and extending generally transversely to the flight plate and immediately adjacent the periphery of the flight plate;

a circumferentially continuous ring composed of polymeric material, coupled to the hub rim, extending across substantially the transverse extent of the hub rim and in cross section extending radially outward of the hub rim, only decreasing in axial extent as it extends radially outward and merging into a generally rounded radially outer periphery;

the hub and the ring have different specific gravities; and the hub having a specific gravity in the range of about 0.92 to 1.25 and the ring having a specific gravity in the range of about 0.96 to 5.0, wherein the ring includes an axially outer surface that is excurvate over its entire length and wherein the ring has a higher specific gravity than the hub.

2. The disc of claim 1 further comprising a weighting product compounded into the polymeric material of the ring.

3. The disc of claim 2 wherein the weighting product includes an aggregate material.

4. The disc of claim 3 wherein the aggregate material includes at least one of barium sulfate, tungsten, tungsten oxide, zinc, or brass.

5. The disc of claim 2 wherein the polymeric material of the ring is the same as the polymeric material of the hub.

6. The disc of claim 1 further comprising:

a weighting product compounded into the polymeric material of the ring, and wherein the specific gravity of the ring with the weighting product is greater than the specific gravity of the hub; and wherein the ring includes an axially inner surface, a radially outer surface, and rounded portions between the radially outer surface and the axially inner and outer surfaces, and wherein the axially inner surface is incurvate over its entire length.

7. The disc of claim 6 wherein the specific gravity of the ring with the weighting product is between 1.0 and 2.5, and the specific gravity of the hub is between 0.95 and 1.18.

8. The disc of claim 1 wherein the polymeric material of the hub includes at least one of a thermoplastic urethane, a thermoplastic vulcanizate, or a styrene-ethylene/butylene-styrene.

9. The disc of claim 1 wherein the polymeric material of the ring has a durometer between 20 and 55 on the Shore D scale.

10. The disc of claim 1 wherein the polymeric material of the hub has a durometer between 30 and 70 on the Shore D scale.

11. The disc of claim 1 wherein the durometer of the polymeric material of the ring is between 25 and 50 on the Shore D scale and the durometer of the polymeric material of the hub is between 40 and 60 on the Shore D scale.

12. The disc of claim 2 wherein the weighting product includes a plurality of discrete weight inserts.

13. The disc of claim 12 wherein the plurality of discrete weight inserts includes between three and sixteen weight inserts.

14. The disc of claim 2 wherein the weighting product is located at the circumference of the ring, radially inward of an outer diameter surface formed by the polymeric material.

15. The disc of claim 2 wherein the weighting product is embedded in the hub.

16. The disc of claim 15 wherein the hub with the embedded weighting product has a specific gravity between 1.1 and 1.4, and the ring has a specific gravity between 0.92 and 1.18.

17. The disc of claim 16 wherein the specific gravity of the hub with the embedded weighting product is between 1.15 and 1.25, and the specific gravity of the ring is between 1.0 and 1.14.

18. The disc of claim 1 wherein the hub rim has a radially outer surface, and wherein the ring is overmolded to the hub rim and the ring includes a weighting product compounded into the polymeric material of the ring.

19. The disc of claim 18 wherein the hub rim extends from a radially outer periphery of the flight plate in a generally axial direction and includes a radially outer surface that is convex in a radial direction, wherein the ring is coupled to the radially outer surface of the hub rim.

20. The disc of claim 19, wherein the hub rim also includes a radially inner surface that is conical and expanding radially outward in a direction extending away from the flight plate, and an axial end surface between the radially outer and inner surfaces.

21. The disc of claim 18 wherein the hub rim includes a radially outer surface, a radially inner surface, an axial end surface between the outer and inner surfaces, and the ring includes an axially outer surface, an axially inner surface, a radially outer surface, and a radially inner surface disposed radially inward of the hub rim.

22. The disc of claim 21 wherein the radially outer surface of the hub rim is excurvate and the radially inner surface of the hub rim is incurvate.

23. A weighted flying disc, comprising:

a one-piece molded hub composed of polymeric material and including a central axis, a flight plate extending in a direction transversely with respect to the central axis, and a hub rim depending from the perimeter of the flight plate and having a generally axial extent of about 5% to 12% of the diameter of the disc;

a circumferentially continuous molded ring composed of polymeric material coupled to at least a portion of the hub rim, having an inner diameter in the range of 12 centimeters to 20 centimeters, extending at least substantially across the transverse extent of the hub rim, and in cross section extending radially outward of the hub rim, decreasing in axial extent as it extends radially outward and merging into a generally rounded radially outer periphery;

a separate weighting product compounded into the polymeric material of the ring;

the hub having a specific gravity in the range of about 0.92 to 1.25 and the weighting product and ring combined having a specific gravity in the range of about 0.96 to 5.0 and greater than the specific gravity of the hub; and the maximum overall weight of the flying disc is not more than 200 grams.

24. The disc of claim 1 wherein the flight plate has a dome configuration at least substantially throughout its transverse extent.

25. The disc of claim 1 wherein the circumferentially continuous ring has an excurvate outer surface extending from an axial edge of the hub proximate to the flight plate to the generally rounded radially outer periphery of the ring and an incurvate surface extending from an axial edge of the hub rim distal from the plate to the generally rounded radially outer periphery of the ring.

26. The disc of claim 1 wherein the maximum overall weight of the disc is 200 grams.

27. The disc of claim 1 wherein the maximum overall weight of the disc is 200 grams and the maximum diameter of the disc is 30 centimeters.

28. The disc of claim 1 wherein the maximum overall weight of the disc is 200 grams, the maximum diameter of the disc is 30 centimeters, and the transverse extent of the hub rim is in the range of 5% to 12% of the outside diameter of the disc.

29. The disc of claim 1 wherein the axial thickness of the flight plate is in the range of 0.025 centimeters to 0.25 centimeters and the hub rim has a thickness in the range of 0.5 centimeters to 2.6 centimeters.

30. The disc of claim 6 wherein the flight plate includes an axially outer beveled surface at a radially peripheral portion of the flight plate adjacent to the hub rim, and wherein the axially outer surface of the ring is a continuation of the beveled surface to establish a continuous external surface of the disc.

31. The disc of claim 6 wherein the flight plate includes an axially outer surface and the hub rim includes a radially outer surface and an axial end surface, and wherein the axially outer surface of the ring extends from a corner between the axially outer surface of the flight plate and the radially outer surface of the hub rim, and the axially inner surface of the ring extends from the axial end surface of the hub rim, and the ring includes a radially inner surface overmolded to the radially outer surface of the hub rim.

32. A flying disc, comprising:

a unitary, one-piece hub composed of polymeric material and including a central axis, a circular and unperforated flight plate extending in a direction transversely with respect to the central axis, and a hub rim depending from and extending generally transversely to the flight plate and immediately adjacent the periphery of the flight plate;

a circumferentially continuous ring composed of polymeric material, coupled to the hub rim, extending across substantially the transverse extent of the hub rim and in cross section extending radially outward of the hub rim, decreasing in axial extent as it extends radially outward and merging into a generally rounded radially outer periphery; and wherein the ring includes an axially outer surface, an axially inner surface, a radially outer surface, and rounded portions between the radially outer surface and the axially inner and outer surfaces, and wherein the axially outer surface is excurvate over its entire length, and the axially inner surface is incurvate over its entire length; and wherein the bub and the ring are constructed by molding.

* * * * *